US011482819B2

(12) United States Patent
Kliever

(10) Patent No.: US 11,482,819 B2
(45) Date of Patent: Oct. 25, 2022

(54) COMPACT ADD-ON HOUSING

(71) Applicant: HARTING ELECTRIC GMBH & CO. KG, Espelkamp (DE)

(72) Inventor: Wilhelm Kliever, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/767,853

(22) PCT Filed: Nov. 28, 2018

(86) PCT No.: PCT/DE2018/100962
§ 371 (c)(1),
(2) Date: May 28, 2020

(87) PCT Pub. No.: WO2019/114863
PCT Pub. Date: Jun. 20, 2019

(65) Prior Publication Data

US 2020/0373716 A1 Nov. 26, 2020

(30) Foreign Application Priority Data

Dec. 13, 2017 (DE) ..... 10 2017 129 742.1

(51) Int. Cl.
*H01R 13/502* (2006.01)
*H01R 13/74* (2006.01)
*H01R 43/26* (2006.01)

(52) U.S. Cl.
CPC ..... *H01R 13/748* (2013.01); *H01R 13/745* (2013.01); *H01R 43/26* (2013.01)

(58) Field of Classification Search
CPC ..... H01R 13/6215; H01R 13/518; H01R 23/7073; H01R 13/745; H01R 33/7628; H01R 13/514; H01R 9/26; H01R 13/748
(Continued)

(56) References Cited

U.S. PATENT DOCUMENTS 4,659,162 A 4/1987 Cartesse
5,104,333 A * 4/1992 Hatagishi ..... H01R 13/62922 439/342

(Continued)

FOREIGN PATENT DOCUMENTS

DE 20 2007 004 350 U1 8/2008
DE 10 2014 109 351 B3 7/2015

(Continued)

OTHER PUBLICATIONS

International Preliminary Report On Patentability dated Jun. 16, 2020 for International Application No. PCT/DE2018/100962, 8 pages.

(Continued)

*Primary Examiner* — Thanh Tam T Le
(74) *Attorney, Agent, or Firm* — Seed IP Law Group LLP

(57) ABSTRACT

An add-on housing for a plug-in connection is provided and includes a frame-like basic form, wherein fastening devices for fastening the add-on housing to a wall aperture are integrally formed within the frame-like basic form, wherein the add-on housing has at least one clamping element which can be captively clamped within the frame-like basic form, and wherein a holding frame or a contact insert can be fixed to the at least one clamping element. A method for fastening an add-on housing to a wall aperture is also provided, wherein: a frame-like basic form is fixed to the wall aperture by internal fastening devices; then, at least one clamping element, but preferably two clamping elements, is/are fixed within the frame-like basic form without tools; and a holding frame which is fitted with plug-in connector modules or a contact insert is then mounted onto the clamping elements and fixed thereto.

12 Claims, 2 Drawing Sheets

(58) Field of Classification Search
USPC ..... 439/362, 540.1, 541.5, 565, 569, 701, 439/716
See application file for complete search history.

(56) References Cited

U.S. PATENT DOCUMENTS

| | | | | |
|---|---|---|---|---|
| 5,252,089 | A * | 10/1993 | Hatagishi | B60R 16/02 439/310 |
| 6,004,162 | A * | 12/1999 | Harting | H01R 13/518 439/532 |
| 6,004,163 | A * | 12/1999 | Behling | H01R 13/514 439/701 |
| 6,491,530 | B2 * | 12/2002 | Koide | H01R 13/193 439/92 |
| 6,520,781 | B2 * | 2/2003 | Koide | H01R 13/748 439/97 |
| 6,533,615 | B2 * | 3/2003 | Koide | H01R 13/6582 439/607.48 |
| 6,599,149 | B2 * | 7/2003 | Chen | H01R 13/745 439/565 |
| 7,044,782 | B2 * | 5/2006 | Enami | H01R 13/648 439/564 |
| 7,316,591 | B2 * | 1/2008 | Ferderer | H01R 13/506 439/532 |
| 9,478,921 | B2 * | 10/2016 | Osawa | H01R 13/748 |
| 9,502,813 | B2 * | 11/2016 | Dugo | H01R 13/512 |
| 9,865,958 | B2 * | 1/2018 | Beischer | H01R 13/512 |
| 10,050,391 | B2 * | 8/2018 | Herbrechtsmeier | H01R 9/16 |
| 10,106,109 | B2 * | 10/2018 | Kawai | B60L 53/16 |
| 10,170,854 | B2 * | 1/2019 | Herbrechtsmeier | H01R 13/506 |
| 10,389,060 | B2 * | 8/2019 | Diessel | H01R 13/73 |
| 10,944,200 | B2 * | 3/2021 | Herron | H01R 31/06 |
| 10,958,010 | B2 * | 3/2021 | Lindkamp | H01R 13/518 |
| 2012/0244754 | A1 | 9/2012 | Riepe et al. | |
| 2015/0079839 | A1 | 3/2015 | Takemura | |
| 2017/0110824 | A1 | 4/2017 | Beischer | |
| 2018/0309227 | A1 | 10/2018 | Diessel et al. | |
| 2019/0334278 | A1 | 10/2019 | Wolff et al. | |

FOREIGN PATENT DOCUMENTS

| | | | |
|---|---|---|---|
| EP | 0 183 587 | B1 | 1/1989 |
| EP | 0 860 906 | B1 | 5/2004 |
| JP | 2015-60681 | A | 3/2015 |
| WO | 2011/069522 | A1 | 6/2011 |
| WO | 2017/072132 | A1 | 5/2017 |
| WO | 2017/220736 | A1 | 12/2017 |

OTHER PUBLICATIONS

China National Intellectual Property Administration, Office Action for Chinese Application No. 201880079986.2; dated Dec. 16, 2020; 8 pages.

European Patent Office, International Search Report for international application No. PCT/DE2018/100962, dated Feb. 26, 2019, 13 pages (with English translation).

German Patent Office, Office Action for German application No. 10 2017 129 742.1, dated Oct. 9, 2018, 8 pages.

* cited by examiner

COMPACT ADD-ON HOUSING

BACKGROUND

Technical Field

This disclosure relates to a bulkhead mounted housing and a method for fastening a bulkhead mounted housing to a wall aperture.

Bulkhead mounted housings are known per se. Bulkhead mounted housings are, for example, mounted on wall apertures of control cabinet or machine walls to provide an option for a plug connection there.

Description of the Related Art

DE 20 2007 004 350 U1 discloses a bulkhead mounted housing, which can be assembled on an aperture of a device wall. The bulkhead mounted housing has a frame-like base form. Fastening openings, via which the bulkhead mounted housing can be screwed to the device wall, are integrally formed externally on the frame-like base form. To ensure leak-tightness of the bulkhead mounted housing with respect to environmental influences, the bulkhead mounted housing has a groove on the device side, into which a sealing ring is placed. To further ensure the leak-tightness of the bulkhead mounted housing, the fastening openings are also each equipped with a sealing ring.

During the assembly of the bulkhead mounted housing of DE 20 2007 004 350 U1, care must be taken to ensure the absolutely correct seating of a plurality of seals. The assembly of such a bulkhead mounted housing is therefore very time consuming. The bulkhead mounted housing moreover requires a lot of space on the device wall as a result of the externally integrally formed fastening openings.

The German Patent and Trademark Office has searched the following prior art in the priority application relating to the present application: DE 20 2007 004 350 U1; EP 0 860 906 B1; WO 2011/069522 A1; WO 2017/220736 A1 and JP 2015-60681 A.

BRIEF SUMMARY

Embodiments of the invention provide a compact bulkhead mounted housing which is easy to assemble.

The bulkhead mounted housing according to embodiments of the invention is intended to provide a plug connection in the region of an aperture of a control cabinet or a device wall. However, the invention is not restricted to this use.

The bulkhead mounted housing according to an embodiment of the invention has a frame-like base form, wherein the aperture opening of the control cabinet or the device wall is arranged within the frame-like base form. Within the frame-like base form, the bulkhead mounted housing has fastening devices or means for fastening the bulkhead mounted housing to the wall aperture. The fastening devices or means are generally arranged in the vicinity of the edge region of the aperture opening.

The bulkhead mounted housing is preferably equipped with a seal, which is arranged between the bulkhead mounted housing and the device wall. Since the fastening devices or means are located within the frame-like base form, additional sealing means do not have to be provided here to protect the bulkhead mounted housing from environmental influences.

The bulkhead mounted housing has at least one clamping element, which can be captively clamped within the frame-like base form. The clamping element is held or secured within the frame-like base form by a clamping action. A tool is not required for this. The technical clamping structures required for this are contained on the clamping element and will be described in more detail further below.

A holding frame or a contact insert can be secured on the at least one clamping element. The holding frame can be fitted with different plug connector modules in a known modular manner. The plug connection for the control cabinet or for the device is provided via the holding frame with plug connector modules or the plug insert.

The plug connector modules generally each have a substantially cuboidal insulating body. These insulating bodies can serve as contact carriers, for example, and can receive and secure a wide range of different contacts. The operation of a plug connector or bulkhead mounted housing formed in this way is also very flexible. For example, pneumatic modules, optical modules, modules for the transmission of electrical energy and/or electrical analog and/or digital signals can be accommodated in the respective insulating body and can therefore be used in the plug connector modular system. Plug connector modules increasingly also assume measurement- and data-related tasks.

The fastening devices or means of the bulkhead mounted housing are advantageously openings via which the bulkhead mounted housing can be secured to the wall aperture. For example, the bulkhead mounted housing can be screwed or riveted to the wall aperture via the openings. A fastening of this type is particularly stable and especially advantageous in environments subject to vibration loads, for example in the rail sector.

The clamping element of the attachment housing preferably has openings via which the holding frame or the contact insert can be secured on the clamping element. The holding frame or the contact insert can be screwed to the clamping element, and therefore connected to the bulkhead mounted housing, by way of these openings.

In a particularly advantageous embodiment of the invention, the openings of the bulkhead mounted housing and the openings of the clamping element are each flush or aligned with one another. A particularly space-saving design of the bulkhead mounted housing can thus be achieved.

In a particularly advantageous embodiment of the invention, the bulkhead mounted housing has at least two clamping elements. The clamping elements are each arranged, parallel to one another, on the narrow sides of the frame-like base form of the bulkhead mounted housing. By using two clamping elements, these can be used for different structural sizes of the bulkhead mounted housing. The bulkhead mounted housing can thus be produced essentially more economically because the same components, here the clamping elements, can sometimes be used for different structural sizes.

The clamping element preferably consists of or includes at least two parts, a first part and a second part. The two parts are coupled to one another via a hinged connection. The hinged connection is positioned between the ends of the clamping element.

It is advantageous to additionally couple to the two parts to one another via a spring element. The spring element can be arranged, for example, at an end of the clamping element.

The two parts of the clamping element which are connected to one another in a hinged manner form peg-like clamping jaws at one end, the end remote from the hinged connection. The other end forms lever arms, by which the clamping jaws can be brought into an open position in opposition to the force of the spring element. Without the force effect, the spring element presses the clamping jaws into a closed position.

The spring element is preferably a spiral spring or a leaf spring. Components of this type are commercially available at little cost.

The bulkhead mounted housing preferably has at least one web within the frame-like base form. The clamping element has a corresponding grip hook acting on the web with form fit. The grip hook is integrally formed on part of the clamping element and positioned on the end of the clamping element which is remote from the hinged connection. The grip hook promotes the clamping jaw function described above. The grip hook is pressed against the web by the clamping jaws. The clamping element can thus be fastened to the bulkhead mounted housing without tools.

If two clamping elements are used, they may be constructed identically to one another. In this case, a web, on which a respective clamping element can act, is integrally formed internally on both narrow sides.

At least one fastening element for a hood is preferably integrally formed externally on the frame-like base form. As a result of the externally mounted fastening element(s), the interior can be used for the components relevant to the plug connection.

It has been shown that at least two fastening elements arranged diagonally to one another represent an adequate option for securing a hood.

BRIEF DESCRIPTION OF THE SEVERAL VIEWS OF THE DRAWINGS

Exemplary embodiments of the invention are illustrated in the drawings and will be explained in more detail below.

The figures contain partially simplified schematic illustrations. Identical reference signs are sometimes used for elements which are similar, but possibly not identical. Different views of similar elements could be drawn to different scales.

DETAILED DESCRIPTION

Figure 1:
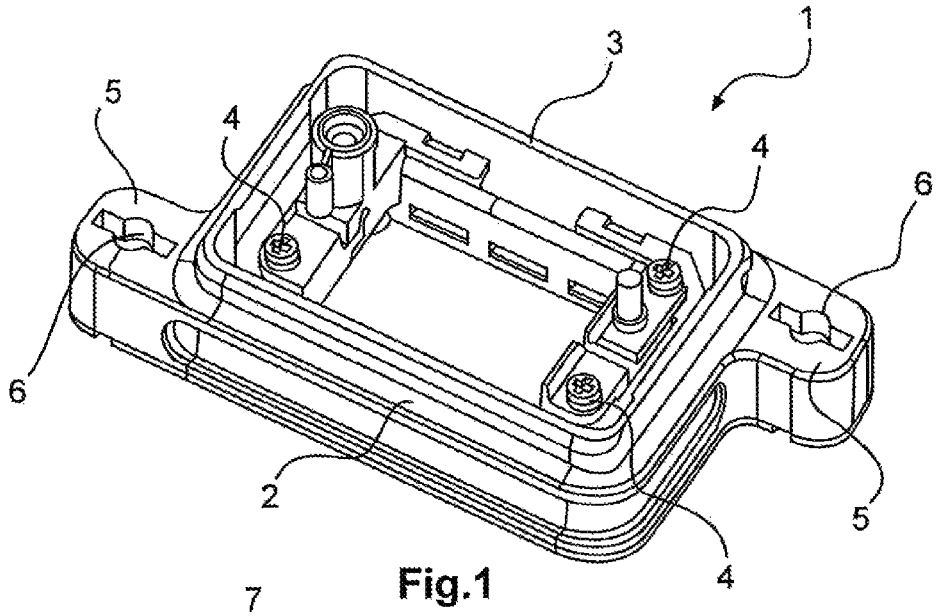
FIG. 1 is a perspective illustration of a bulkhead mounted housing according to an embodiment of the invention, FIG. 2 a perspective illustration of two clamping elements, FIG. 3 a detail of an alternative clamping element, FIG. 4 a plan view of a frame-like base form and FIG. 5 a sectional illustration of the frame-like base form with clamping elements clamped thereto.

FIG. 1 shows a perspective illustration of a bulkhead mounted housing 1 according to an example embodiment of the invention. The bulkhead mounted housing 1 has a frame-like base form 2. A holding frame 3 for plug connector modules (not shown for illustrative reasons) is fastened within the frame-like base form 2 via a screw connection 4. The holding frame 3 and its mode of operation is known, for example, from EP 0 860 906 B1. Fastening elements 5 for a hood, which are arranged diagonally to one another, are integrally formed externally on the frame-like base form 2. The fastening elements 5 contain keyhole-like openings 6, in which the hood can engage. Since the hood is not a subject matter of the present invention, it is neither shown nor described in more detail.

Figure 2:
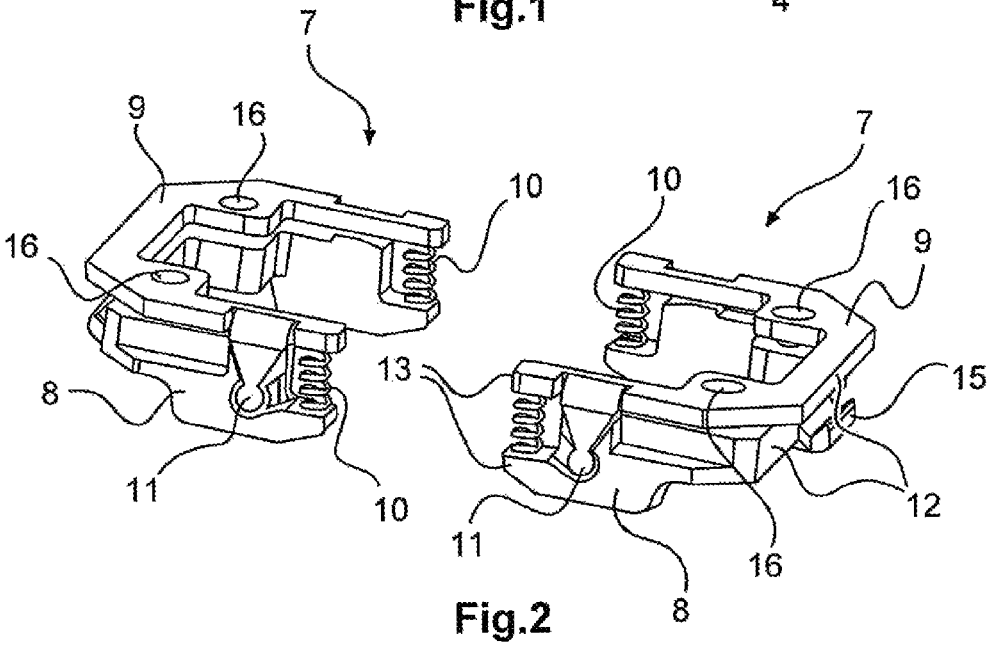

In FIG. 2, two clamping elements 7 are illustrated opposite one another in a perspective view. The clamping element 7 consists of a first part 8, which has a hinge receptacle, and a second part 9, which has a hinge head which matches the hinge receptacle and engages in the hinge receptacle of the first part 8 to form a hinged connection 11. The two parts 8, 9 are coupled to one another via a spring element 10. The spring element 10 is constructed as a spiral spring here.

The two parts 8, 9 of the clamping elements 7 which are connected to one another in a hinged manner form peg-like clamping jaws 12 at one end, the end remote from the hinged connection 11. The other end forms lever arms 13, by way of which the clamping jaws 12 can be brought into an open position in opposition to the force of the spring element 10. Without the force effect, the spring element 10 presses the clamping jaws 12 into a closed position, as illustrated in FIG. 2.

Figure 3:
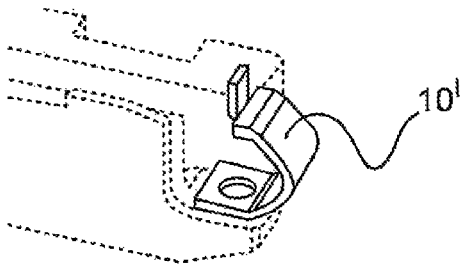

It can be seen in FIG. 3 that the spring element 10' can also be configured as a leaf spring.

Figure 4:
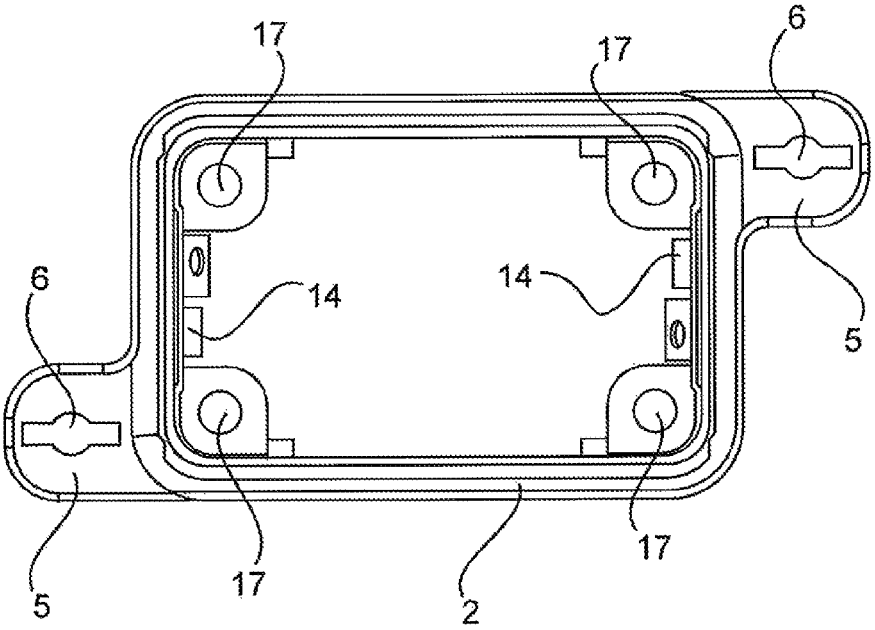
Figure 5:
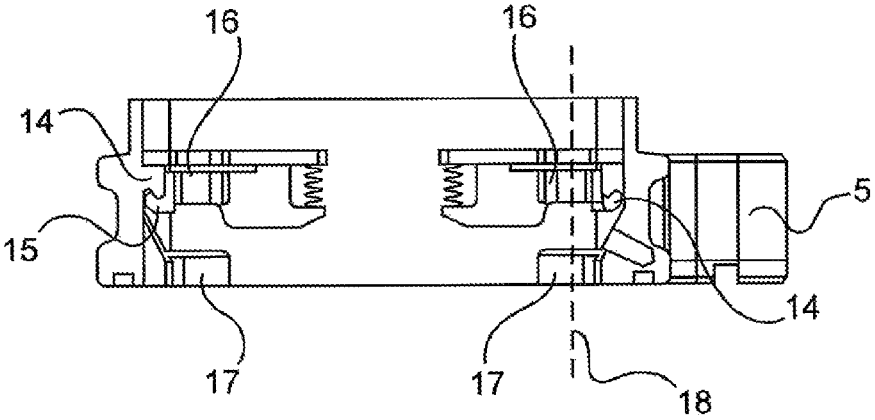

FIGS. 4 and 5 reveal that the bulkhead mounted housing 1 has at least one web 14 within the frame-like base form 2. The clamping element 7 has a grip hook 15 corresponding to the web 14 and acting thereon with form fit. The grip hook 15 is integrally formed on the first part 8 of the clamping element 7 and positioned at the end of the clamping element 7 which is remote from the hinged connection 11. The grip hook 15 promotes the clamping jaw function described above. The grip hook 15 is pressed against the web 14 by the clamping jaws 12. The clamping element 7 can thus be fastened in the bulkhead mounted housing 1 without tools.

The clamping element 7 has openings 16, which are integrally formed within the second part 9. By way of example, a holding frame 3 can be fastened via a screw connection 4 to the clamping element 7 or to the two clamping elements 7 via the openings 16, as illustrated in FIG. 1. Screwing the holding frame 3 to the clamping element 7 or the clamping elements 7 locks the clamping jaws 12 in their closed position. The clamping jaws 12 are pressed even more tightly against the internal web 14 of the frame-like base body 2 during the screwing procedure. The clamping element 7 or the clamping elements 7, including the holding frame 3, are thus firmly secured in the frame-like base body 2.

The clamping elements 7 are preferably manufactured from an electrically conductive metal material. The bulkhead mounted housing 1 also preferably comprises or consists of an electrically conductive material. By securing the clamping connection of the clamping elements 7 with the aid of the screw connection 4 of the preferably metal holding frame 3 or the plug insert, a reliable PE contact between the holding frame 3 or between the plug insert and the frame-like base form 2 of the bulkhead mounted housing 1 via the clamping elements 7 is ensured. To this end, likewise suitable metal components are contained in the plug insert.

Openings 17 are integrally formed within the frame-like base form 2 of the bulkhead mounted housing 1. The bulkhead mounted housing 1 can be fastened to an aperture (not shown) of a control cabinet (not shown) or a device wall (not shown) via the openings 17. A screw connection is generally selected for this purpose. The openings 17 of the frame-like base form 2 and the openings 16 of the respective clamping elements 7 are flush with one another. This is illustrated by way of an axis 18 in FIG. 5.

The bulkhead mounted housing 1 is mounted on a wall aperture as follows:

The frame-like base form 2 is firstly secured to the wall aperture via the internal openings 17. This generally takes place via a screw connection.

The clamping elements 7 are then secured without tools to the respective narrow sides of the frame-like base form 2—via the clamping jaw function described above.

A holding frame 3 or a contact insert is then seated on the clamping elements 7 and secured thereto by way of the openings 16—for example via a screw connection 4.

The securing of the holding frame 3 or the contact insert to the clamping elements 7 likewise ensures stable securing of the holding frame 3 or contact insert to the frame-like base form 2.

The bulkhead mounted housing 1, together with the holding frame 3 or contact insert fitted with plug connector modules, is then secured on the wall aperture.

The bulkhead mounted housing 1 described above is constructed in a particularly space-saving manner. The clamping elements 7 are universally usable for different structural sizes. The bulkhead mounted housing 1 is particularly leak-tight as a result of internal fastening devices or means and can be easily fastened to the wall aperture without a special tool.

Even when combinations of different aspects or features of the invention are shown in each case in the figures, it is clear to the person skilled in the art—unless indicated otherwise—that the combinations illustrated and discussed are not the only options. In particular, mutually corresponding units or feature complexes from different exemplary embodiments can be interchanged with one another.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A bulkhead mounted housing for a plug connection, the bulkhead mounted housing comprising:

a frame-like base form that defines an internal receiving area for a holding frame or a contact insert, wherein fastening devices for fastening the bulkhead mounted housing to a wall aperture are integrally formed within the frame-like base form; and at least one spring-biased clamping element that is separate and distinct from the frame-like base form, and the at least one spring-biased clamping element includes opposing clamping jaw parts that are hingedly coupled to each other and movable between an open position and a closed position to clamp onto a portion of the frame-like base form to retain the spring-biased clamping element within the internal receiving area of the frame-like base form by moving from the open position to the closed position, and wherein the holding frame or the contact insert can be secured on the at least one spring-biased clamping element within the internal receiving area of the frame-like base form.

2. The bulkhead mounted housing as claimed in claim 1, wherein the fastening devices are frame openings formed in the frame-like base form via which the bulkhead mounted housing can be secured to the wall aperture.

3. The bulkhead mounted housing as claimed in claim 2, wherein the spring-biased clamping element has clamp openings via which the holding frame or the contact insert can be secured on the spring-biased clamping element.

4. The bulkhead mounted housing as claimed in claim 3, wherein the fastening devices in the form of the frame openings within the frame-like base form of the bulkhead mounted housing and the clamp openings of the spring-biased clamping elements are axially aligned with each other.

5. The bulkhead mounted housing as claimed in claim 1, wherein the at least one spring-biased clamping element of the bulkhead mounted housing comprises at least two spring-biased clamping elements.

6. The bulkhead mounted housing as claimed in claim 1, wherein the opposing clamping jaw parts of the spring-biased clamping element are formed from at least two parts, a first part and a second part.

7. The bulkhead mounted housing as claimed in claim 6, wherein the at least two parts are coupled to one another via a hinged connection.

8. The bulkhead mounted housing as claimed in claim 6, wherein the at least two parts are coupled to one another via a spring element.

9. The bulkhead mounted housing as claimed in claim 8, wherein the spring element is a spiral spring or a leaf spring.

10. The bulkhead mounted housing as claimed in claim 1, wherein at least one fastening element for a hood is integrally formed externally on the frame-like base form.

11. The bulkhead mounted housing as claimed claim 10, wherein the at least one fastening element for the hood comprises at least two fastening elements arranged on the frame-like base form diagonally to one another.

12. A method for fastening a bulkhead mounted housing to a wall aperture:

securing a frame-like base form of the bulkhead mounted housing to the wall aperture via internal fastening devices, the frame-like base form defining an internal receiving area for a holding frame or a contact insert;

securing at least one spring-biased clamping element that is separate and distinct from the frame-like base form within the internal receiving area of the frame-like base form without tools, the spring-biased clamping element including opposing clamping jaw parts that are hingedly coupled to each other and movable between an open position and a closed position to clamp onto a portion of the frame-like base form to retain the spring-biased clamping element within the internal receiving area of the frame-like base form by moving from the open position to the closed position; and seating and securing the holding frame, fitted with plug connector modules, or the contact insert on the at least one spring-biased clamping element within the internal receiving area of the frame-like base form of the bulkhead mounted housing.

* * * * *